US009149095B2

(12) United States Patent
Inglis

(10) Patent No.: US 9,149,095 B2
(45) Date of Patent: Oct. 6, 2015

(54) WRISTBAND WITH REMOVABLE ORNAMENTS

(71) Applicant: Shaen R. Inglis, Yorkville, IL (US)

(72) Inventor: Shaen R. Inglis, Yorkville, IL (US)

( * ) Notice: Subject to any disclaimer, the term of this patent is extended or adjusted under 35 U.S.C. 154(b) by 149 days.

(21) Appl. No.: 13/972,354

(22) Filed: Aug. 21, 2013

(65) Prior Publication Data

US 2015/0052943 A1 Feb. 26, 2015

(51) Int. Cl.
*A44C 5/00* (2006.01)
*A44C 17/02* (2006.01)

(52) U.S. Cl.
CPC ..... *A44C 17/0208* (2013.01); *A44C 5/0069* (2013.01)

(58) Field of Classification Search
CPC ..... A44C 17/0208; A44C 5/0069
See application file for complete search history.

(56) References Cited

U.S. PATENT DOCUMENTS 8,142,053 B2 * 3/2012 Hurwitz ..... 362/249.16
8,474,284 B2 * 7/2013 Rush et al. ..... 63/40

* cited by examiner

*Primary Examiner* — Jack W Lavinder
(74) *Attorney, Agent, or Firm* — Dale J. Ream

(57) ABSTRACT

A wristband for wear upon the wrist of a wearer includes a band member having a continuous length configured to encircle the wrist of a wearer, the band member having an outer surface oriented away from the wearer's body and an opposed inner surface oriented against the wearer's body. The wristband includes at least a first ornament selectively and interchangeably coupled to an outer surface of the band member.

7 Claims, 7 Drawing Sheets

WRISTBAND WITH REMOVABLE ORNAMENTS

BACKGROUND OF THE INVENTION

This invention relates generally to wristbands and, more particularly, to a wristband having a plurality of ornaments that may be selectively interchanged.

Wristbands are encircling strips worn on the wrist of a person that may be functional or decorative. An example of a functional wristband is a wristband made of an absorbent cloth material may be worn to absorb sweat, such as while playing a sport. By contrast, a decorative wristband is one that identifies with a movement, cause, or event. A decorative wristband may be constructed of silicone and include indicia indicative of a charitable organization, company name, or advertising campaign.

Although assumably effective for their intended purposes, traditional decorative wristbands do not enable a user to incrementally add ornamentation such as to indicate changes in status, bases of inspiration, or other milestone events. Therefore, it would be desirable to have a decorative wristband having a plurality of ornaments that may be selectively and interchangeably coupled thereto. Further, it would be desirable to have a decorative wristband having interchangeable band portions such that the wristband may be personalized to a particular wearer.

SUMMARY OF THE INVENTION

A wristband for wear upon the wrist of a wearer according to the present invention includes a band member having a continuous length configured to encircle the wrist of a wearer, the band member having an outer surface oriented away from the wearer's body and an opposed inner surface oriented against the wearer's body. The wristband includes at least a first ornament selectively and interchangeably coupled to the outer surface of the band member.

Therefore, a general object of this invention is to provide a wristband having a continuous loop band portion to which a plurality of ornamental stripes is individually and selectively coupled.

Another object of this invention is to provide a wristband, as aforesaid, in which each ornament has a configuration indicative of a merit, rank, or status stripe.

Still another object of this invention is to provide a wristband, as aforesaid, in which the ornaments may be added incrementally and may be interchanged as desired.

Yet another object of this invention is to provide a wristband, as aforesaid, having two band portions interchangeably coupled to one another so as to personalize the wristband.

A further object of this invention is to provide a wristband, as aforesaid, that is easy to assemble and modify.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
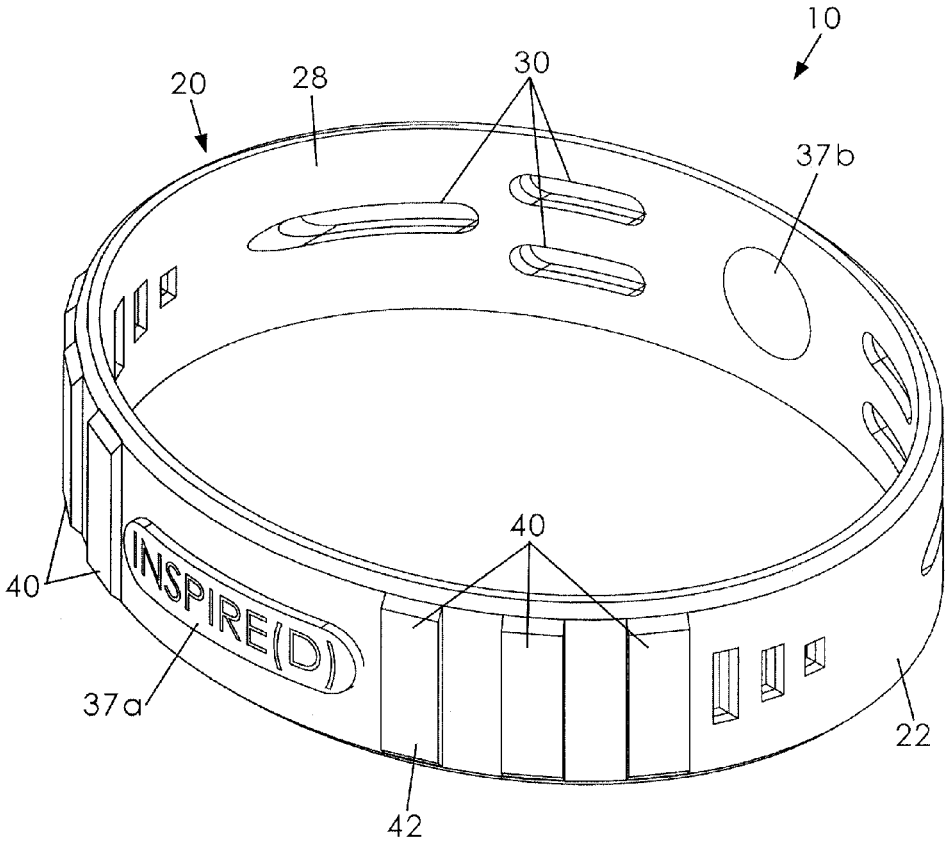
FIG. 1 is a perspective view of a wristband according to a preferred embodiment of the present invention.
Figure 2:
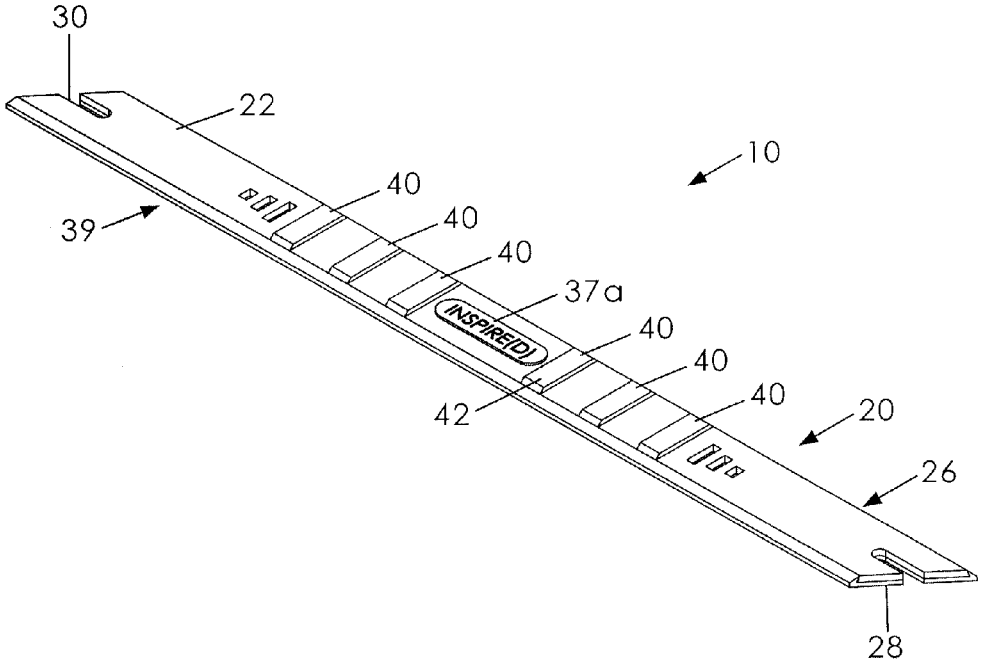
FIG. 2 is perspective view of the wristband as in FIG. 1 that is separated to lay flat.
Figure 3:
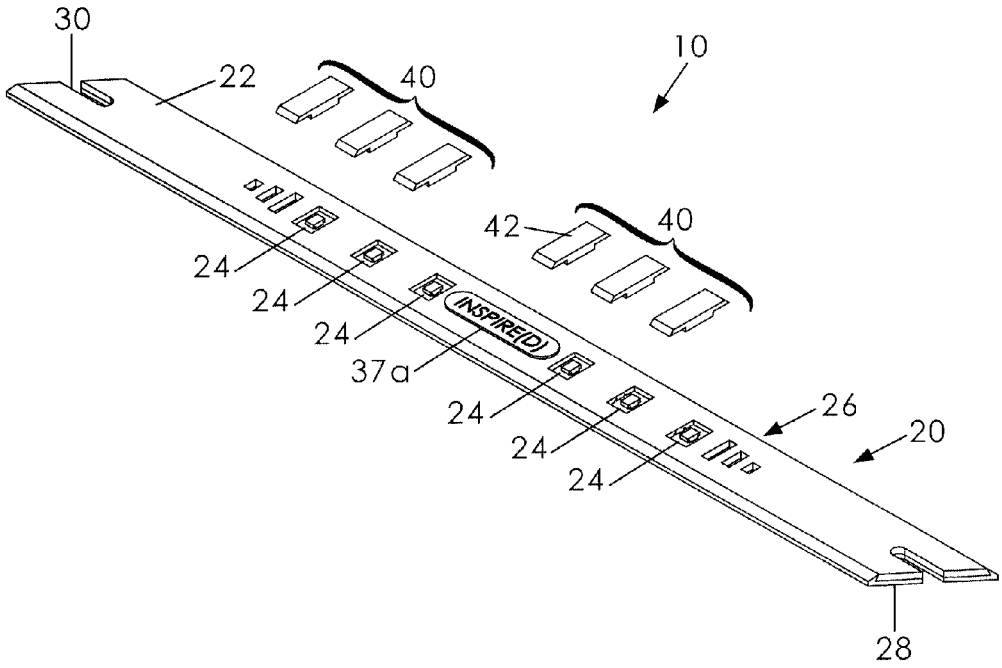
FIG. 3 is an exploded view of the wristband as in FIG. 2.

A wristband for wear upon the wrist of a person according to a preferred embodiment of the present invention will now be described in detail with reference to FIGS. 1 to 6 of the accompanying drawings. The wristband 10 includes a band member 20 and a plurality of ornaments 40 removably coupled to an outer surface 22 of the band member 20.

The band member 20 includes a continuous length having a circular configuration to selectively encircle the wrist of a wearer when inserted thereon. The band member 20 includes an outer surface 22 oriented away from the wearer's body and an inner surface 28 oriented against the wearer's body. Opposed side edges 26 define a width dimension of the band member 20. The band member 20 has no opposed ends as it has a continuous loop configuration as a wristband. Preferably, the band member 20 is constructed of medical grade silicone.

A first ornament 42 is releasably coupled to the outer surface 22 of the band member 20. More particularly, the outer surface 22 of the band member 20 may define a recess 24. The first ornament 42 may include a fastener 44 such as a pair of spaced apart prongs 46 as shown in FIG. 4*b*. The recess 24 is configured to receive the fastener 44 therein in a friction fit relationship or, more particularly, in a snap fit engagement. As shown in FIG. 4*b*, the recess 24 and prongs 46 may be formed in a tongue and groove configuration, the material of which enables the fastener 44 to be selectively snapped into the recess 24 or popped out therefrom. The fastener 44 and the band member 20 are preferably constructed of a semi-rigid rigid material, such as silicone, having a degree of resilience whereby to enable the selective snap-fit type of attachment described above.

The first ornament 42 may also be referred to as a "stripe" as it may have a relatively long and narrow configuration that extends substantially between opposed side edges 26 of the band member 20. The first ornament 42 may have the appearance of a cloth stripe that is indicative of a military rank or designation of merit. In the present invention, it is contemplated that the ornaments will include various indicia indicative of primary colors, faith, family, religion, special achievements, family milestones, sports, personal names, occupational status or promotion, and the like.

Preferably, the wristband 10 according to the present invention includes a plurality of ornaments 40 that may be selectively coupled to the outer surface 22 of the band member 20. It is understood that ornament 42 described above is just an exemplary instance of the plurality of ornaments 40 and need not be confused in the drawings. Further, the outer surface 22 of the band member 20 preferably defines a plurality of spaced apart recesses 24. Additional ornaments 40 may be removably secured into respective recesses 24 over time and are spaced apart from one another along the band member 20. For instance, a stripe indicative of a person's faith may be coupled to the band member 20 upon a religious milestone event such as conversion, baptism, confirmation, bar mitzvah, or the like. Other events leading to adding another stripe to one's personal wristband 10 may include the birth of child, marriage, job promotion, exercise goal accomplishment, or other memorable or inspiring experience.

The band member 20 may also include indicia 37*a* indicative of a brand name, a logo, a company or organizational slogan, or the like. As shown in FIG. 1, the indicia 37*a* may include the word "INSPIRE(D)" so as to indicate that the ornaments represent things that inspire the wearer. The indicia 37*a* may in some embodiments be removable and replaceable. The indicia 37*a* may be positioned on the front of the band member 20 between a pair of adjacent ornaments or in such a way to be surrounded by ornaments 40 extending away in opposite directions. The indicia 37*a* may be positioned and configured in a specific manner in an embodiment in which the band member 20 includes two portions, as will be described below. The band member 20 may also include a second or auxiliary indicia 37*b* having similar characteristics as described above.

The band member 20 defines a plurality of spaced apart apertures 30. As described previously, the band member 20 is preferably constructed of a generally resilient material. Accordingly, the plurality of apertures 30 enhances the ability of the band member 20 to expand in length when stretched. For instance, the band member 20 is able to stretch when a user inserts the band over his hand and onto his wrist. In one embodiment, the apertures 30 may be defined by the inner surface 28 whereas in another embodiment, the apertures 30 may be defined by both the inner surface 28 and outer surface 22.

Figure 4A:
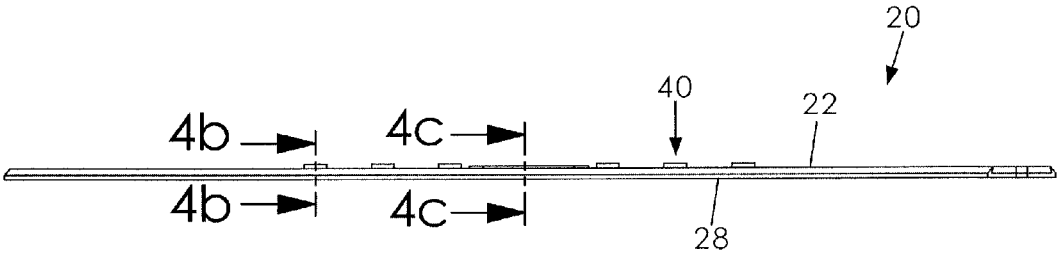
FIG. 4*a* is a side view of the wristband as in FIG. 2.
Figure 4B:
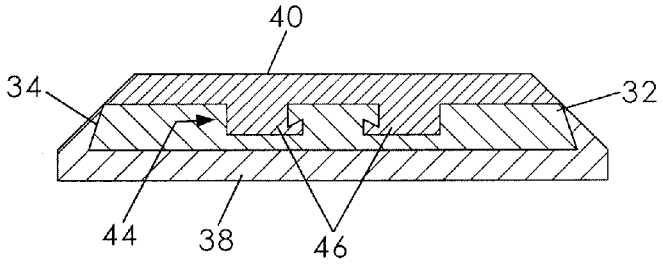
FIG. 4*b* is a sectional view taken along line 4*b*-4*b* of FIG. 4*a;*
Figure 4C:
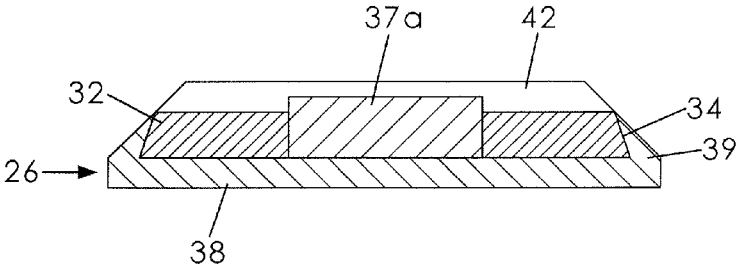
FIG. 4*c* is a sectional view taken along line 4*c*-4*c* of FIG. 4*a;*
Figure 5:
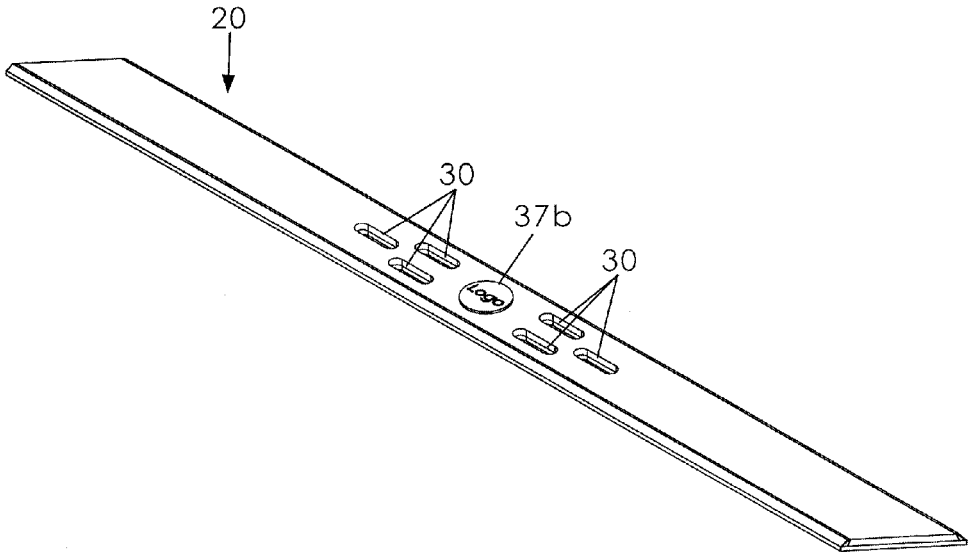
FIG. 5 is a perspective view from a reverse angle of the wristband of FIG. 2.
Figure 6:
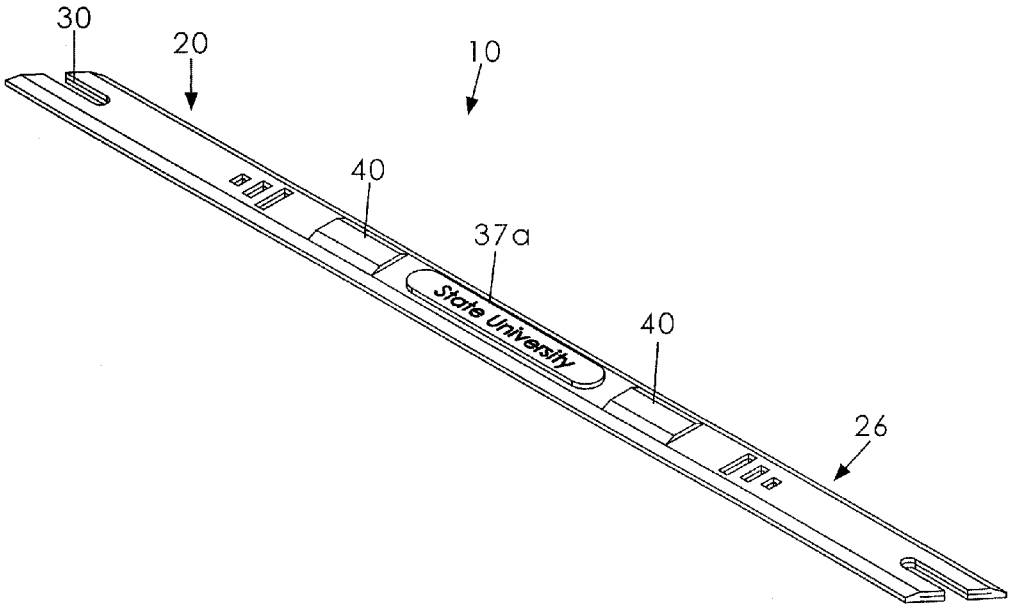
FIG. 6 is a perspective view of the wristband as in FIG. 2 with ornaments attached in an alternative configuration.
Figure 7:
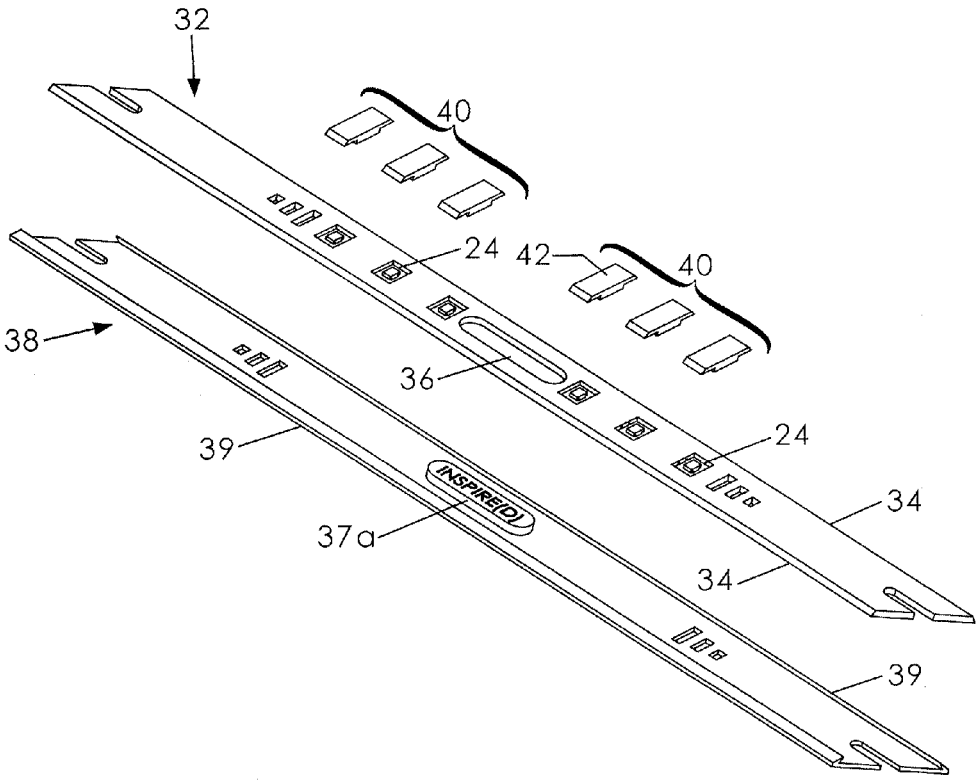
FIG. 7 is an exploded view of the wristband as in FIG. 2 illustrating a two-band configuration.

In one embodiment, the band member 20 includes an outer band portion 32 and an inner band portion 38 (FIGS. 4 and 7). The outer band portion 32 includes the outer surface 22 described above and the inner band portion 38 includes the inner surface 28 described above. The double band embodiment provides enhanced strength and durability that is resistant to tearing, cutting, or the like. The outer band portion 32 is releasably coupled to the inner band portion 38. The outer band portion 32 defines the plurality of recesses 24 configured to receive the plurality of ornament fasteners 44, respectively.

With further regard to the outer and inner band portions, the outer band portion 32 includes outer band side edges 34 and the inner band portion 38 includes inner band side edges 39 (FIG. 7). The inner band portion 38 defines a width that is greater than a width of the outer band portion 32. Accordingly, the outer band portion 32 is selectively received onto the inner band portion 38 and the side edges 34, 39, respectively, are configured to be selectively coupled together in a friction fit engagement. In this embodiment, therefore, various inner and outer band portions may be selected and coupled together so as to customize and personalize the band member 20. For example, a wearer may choose band portions having the same or different colors so as to associate the band member 20 with a particular college, church, community association, or personality.

The band member portions may also include additional structures to selectively couple the band portions together. With more detailed reference the indicia 37*a* described above, the indicia 37*a* may be fixedly attached to the inner band portion 38 and include a raised configuration (FIG. 7). For instance, the indicia 37*a* may be a company logo having a three dimensional and upwardly extending configuration. Further, the outer band portion 32 may define an opening 36 positioned and configured to receive the indicia 37*a* when the respective outer band portion 32 is coupled to the inner band portion 38. Preferably, the indicia 37*a* and opening 36 have complementary configurations such that the inner 38 and outer 32 band portions are releasably coupled together in a friction or snap fit engagement when the outer band portion 32 is situated atop the inner band portion 38.

In use, a wearer may slip a wristband 10 according to the present invention onto his wrist, the wristband being constructed of a silicone or other resilient material that allows moderate stretching to facilitate insertion over the user's hand. The wristband 10 may be personalized by coupling one or many ornaments 40 as described above. Namely, an ornament 40 expressing a milestone in the user's life, an indicator of personality, or merely an artistic expression may be removably coupled to an associated recess 24 or complementary coupling on the band member 20. In one embodiment, the wearer may also select inner 38 and outer 32 band portions and couple them together in a friction fit engagement as described above.

It is understood that while certain forms of this invention have been illustrated and described, it is not limited thereto except insofar as such limitations are included in the following claims and allowable functional equivalents thereof.

The invention claimed is:

1. A wristband for wear upon the wrist of a wearer, comprising:

a band member having a continuous length configured to encircle the wrist of a wearer, said band member having an outer surface oriented away from the wearer's body and an opposed inner surface oriented against the wearer's body;

a plurality of ornaments removably coupled to said outer surface of said band member, each ornament having a respective fastener selectively and removably coupled to said outer surface of said band member;

wherein:

said outer surface of said band member defines a plurality of spaced apart recesses; and said first ornament includes a plurality of ornaments that are spaced apart from one another when respective fasteners are received in said plurality of recesses, respectively;

said outer surface of said band member includes an outer band portion; and said inner surface of said band member includes a inner band portion releasably coupled to said outer band portion; and said outer band portion defines said plurality of recesses;

said inner band portion includes opposed inner band side edges;

said outer band portion includes opposed outer band side edges;

said inner band portion includes a width that is larger than a width of said outer band portion and configured such that said outer band portion is selectively received onto said inner band portion and said inner and outer band side edges are releasably coupled together in a friction fit engagement.

2. The wristband as in claim 1, wherein said outer surface of said band member defines a recess configured to receive a respective ornament fastener in one of a friction fit and a snap fit configuration.

3. The wristband as in claim 2, wherein said fastener and said recess include a tongue and groove configuration, respectively.

4. The wristband as in claim 2, further comprising indicia positioned on said outer surface between a respective pair of said plurality of recesses.

5. The wristband as in claim 1, wherein said band member is constructed of a resilient material and defines a plurality of apertures configured to enable said band member to selectively expand in length.

6. The wristband as in claim 1, wherein each of said plurality of ornaments includes a color indicia.

7. A wristband for wear upon the wrist of a wearer, comprising:

a band member having a continuous length configured to encircle the wrist of a wearer, said band member having an outer surface oriented away from the wearer's body and an opposed inner surface oriented against the wearer's body;

a plurality of ornaments removably coupled to said outer surface of said band member, each ornament having a respective fastener selectively and removably coupled to said outer surface of said band member;

wherein:

said outer surface of said band member defines a plurality of spaced apart recesses;

said first ornament includes a plurality of ornaments that are spaced apart from one another when respective ornament fasteners are received in said plurality of recesses, respectively;

said outer surface of said band member includes an outer band portion; and said inner surface of said band member includes a inner band portion releasably coupled to said outer band portion;

said outer band portion defines said plurality of recesses;

wherein said inner band portion includes indicia having a raised configuration; and wherein said outer band portion defines an opening configured to selectively receive said indicia in a friction fit engagement when said outer band portion is received onto said inner band portion.

* * * * *